US008813437B1

(12) United States Patent
Spofford

(10) Patent No.: US 8,813,437 B1
(45) Date of Patent: Aug. 26, 2014

(54) INTEGRAL SHIM-PACK WITH AN ADJUSTMENT PULL TANG

(71) Applicant: Charles J. Spofford, Greenfield, MA (US)

(72) Inventor: Charles J. Spofford, Greenfield, MA (US)

( * ) Notice: Subject to any disclaimer, the term of this patent is extended or adjusted under 35 U.S.C. 154(b) by 0 days.

(21) Appl. No.: 14/107,061

(22) Filed: Dec. 16, 2013

Related U.S. Application Data

(60) Provisional application No. 61/855,241, filed on May 13, 2013.

(51) Int. Cl.
*E04B 2/82* (2006.01)
*E06B 1/60* (2006.01)

(52) U.S. Cl.
CPC ..... *E06B 1/6069* (2013.01)
USPC ..... 52/126.1; 52/213; 52/217

(58) Field of Classification Search
CPC ..... E06B 1/6069; E06B 1/62; E06B 1/6076; E06B 1/18; E06B 1/20; E02D 27/42
USPC ..... 52/126, 211, 213, 215, 217; 49/308, 49/504, 505; 248/292.12, 298.1, 346.07, 248/229.21, 228.2, 231.31, 670
See application file for complete search history.

(56) References Cited

U.S. PATENT DOCUMENTS

| | | | | | |
|---|---|---|---|---|---|
| 807,613 | A * | 12/1905 | Graves | 81/3.32 |
| 1,335,247 | A * | 3/1920 | Lask | 269/310 |
| 2,524,961 | A * | 10/1950 | Cramer, Jr. | 254/104 |
| 3,171,632 | A * | 3/1965 | Jines | 254/104 |
| 4,480,287 | A * | 10/1984 | Jensen | 361/707 |
| 6,018,916 | A * | 2/2000 | Henry | 52/126.1 |
| 7,156,431 | B2 | 1/2007 | Norgaard | |
| 7,357,364 | B2 | 4/2008 | Jackson et al. | |
| 7,703,727 | B2 * | 4/2010 | Selness | 248/188.2 |
| 8,136,308 | B2 * | 3/2012 | Slott et al. | 52/126.1 |

* cited by examiner

*Primary Examiner* — Brian Glessner
*Assistant Examiner* — Adam Barlow
(74) *Attorney, Agent, or Firm* — Malcolm J. Chisholm, Jr.

(57) ABSTRACT

The integral shim-pack (50) includes a wedge-shaped male shim (52) having a pull tang (68) extending from a thin end (56) of the male shim (52) and into a tang groove (82) and through a tang passage (90) between a bridge (88) and a tang groove (82) of a wedge-shaped female shim (72) to extend beyond a thick end (74) of the female shim (72). Pulling the adjustment pull tang (68) away from the thick end (74) of the female shim (72) moves a thick end (54) of the male shim (52) toward the thick end (74) of the female shim (72) to increase a distance between a base surface (58) of the male shim and a base surface (78) of the female shim (72).

8 Claims, 7 Drawing Sheets

INTEGRAL SHIM-PACK WITH AN ADJUSTMENT PULL TANG

CROSS-REFERENCE TO RELATED APPLICATIONS

This Application claims the benefit of U.S. Provisional Patent Application Ser. No. 61/855,241 that was filed on May 13, 2013 entitled "QUICK SHIMS".

TECHNICAL FIELD

This disclosure relates to wedge-shaped objects commonly referred to as shims utilized for adjusting positions of such things as windows and doors as they are installed in buildings.

BACKGROUND ART

In the field of construction of buildings, such as residences, commercial buildings, etc., it is well known that securing windows and doors requires great care to make sure the windows or doors are installed to be level, plumb and square. The windows or doors must be secured within an opening defined by a frame of the building so that there is a gap between an exterior frame of the window or door and an opening frame of the building. The gap surrounding the window or door must define a sufficient distance between structural surfaces of the frames so that any shifting loads of the opening frame of the building do not compress or re-align the exterior frame of the window or door against the opening frame of the building. By maintaining a gap between the exterior frame of the window or door and the opening frame of the building, loads that are generated by slight movements in the building frame are transferred around the window or door by way of the gap and do not pass through the window or door. If there were no such gap, it is well known that a shifting load could compress the opening frame of the building against the exterior frame of the window or door to make it extremely difficult to properly operate the window or door, and such a shifting load may also misalign the window or door.

It is likewise well known that shims are placed between the exterior frame of an insertable structure such as window or door and the opening frame of the building. Typically, the shims are used in pairs wherein each shim has a thick back end and a thin front end, a flat base surface and an opposed sloped contact surface extending between the ends. It is common that the gap distance between structural surfaces of the frames is more than one-quarter inch and less than one-half inch. Historically, shims have been inexpensive wedge-shaped components made of wood, and many carpenters prefer that the wood be cedar. A classic wooden shim is about six to ten inches long, has about a one-sixteenth inch thin front end and about a three-eighths inch thick back end, and is about one and a quarter inches wide.

An exemplary procedure for utilizing shims to adjust distances between an exterior frame of an insertable structure and an opening frame of a building is as follows. First, to make sure the insertable structure will be level, at least two pairs of shims are placed on a sill (being a portion of the opening frame that defines a bottom of the opening frame and is generally parallel to a reference surface, such as the surface of the earth). A carpenter places a level across both pairs of shims on the sill, and the thick ends of the shims of one or both pairs are moved toward or away from each other to increase or decrease a distance between the base surfaces of the adjacent shims until the level indicates that a plane across the pairs of shims is parallel to the ground (or any other reference surface to which it is desired that the sill be parallel). The pairs of shims are then secured to the sill at the desired thicknesses.

Next, the carpenter rests the insertable structure or window, door, etc. upon the pairs of fixed shims on the sill, which results in the structure being level. In a similar manner, pairs of shims are secured between the opposed vertical sides of the exterior frame of the structure and the opening frame, as well as between a top of the exterior frame and the opening frame. Typically the pairs of shims are inserted from opposing sides of the insertable structure and held in place temporarily by friction between side and top structural surfaces of the opening frame of the building and the exterior frame of the window or door. Then the pairs of shims are adjusted incrementally to vary distances between the sides and top of the exterior frame by moving thick ends of the shims toward or away from each other until measuring tools indicate the sides of the structure are plumb and that the entire structure is square (meaning that diagonal distances from opposed top and bottom corners are identical and that the rectangular or square structure has not become a parallelogram). Incremental adjustment of the shim pairs typically requires two hands; one to hold one shim stationary, and another to tap or pull the other shim of the pair. When the shim pairs are adjusted so that the structure is plumb and square, the shims are secured, such as by a nail gun, to a frame structure of the opening frame, or often through the exterior frame of the insertable structure, through the adjusted shim pair, and into the opening frame.

Many efforts have been undertaken to produce more efficient shims and shim pairs. For example, U.S. Pat. No. 6,018,916 that issued on Feb. 1, 2000 to Henry discloses an adjustable, two-part wedge shim spacer that is to be secured to a portion of an opening frame of a prefabricated building. The shim pairs of Henry utilize a parallel central guide channel and channel follower to assist in correct alignment of the wedge shims. More recently, U.S. Pat. No. 7,156,431 that issued on Jan. 6, 2007 to Norgaard shows a wedge couple for adjusting windows and doors. Norgaard utilizes specially formed mounting shears to move a mated wedge couple toward each other to increase a thickness of the wedge couple. The wedge couple includes a deformable thin plate that connects each wedge of a wedge couple together, to facilitate use of the wedge couples. While having the plate keep the shims adjacent each other affords possible installation with only one hand, unfortunately, use of the mounting shears severely limits practical application of the Norgaard wedge couple and requires use of the other hand.

Even more recently, U.S. Pat. No. 8,136,308 that issued on Mar. 20, 2012 to Slott et al. shows a wedge set wherein one of the wedges includes an upwardly protruding rib including jagged-like teeth on opposed sides of the rib. The other wedge includes a corresponding groove to receive the rib and to provide for irreversible or one-way movement as thick ends of the wedges are moved toward each other. While such an arrangement may achieve limited value in varying distances between structural surfaces, nonetheless the wedge set of Slott et al. involves complexities that limit broad application to different types of structural surfaces and that significantly increases manufacturing costs.

While advances have been made in such shims and shim pairs, there is still a need for low-cost, efficient shims or shim pairs that may be efficiently manufactured and that enhance ease of use and accuracy of application of the shims.

SUMMARY OF THE DISCLOSURE

The disclosure is an integral shim-pack with an adjustment pull tang for adjusting distances between a first structural surface and an opposed second structural surface. The first structural surface may be, for example, a surface of an exterior frame of an insertable window, or door, etc., while the second structural surface may be a surface of an opening frame in a building, such as an opening frame dimensioned for securing a window, or door, etc.

The integral shim-pack includes a wedge-shaped male shim having a thick back end and an opposed thin front end, having a base surface and having an opposed sloped contact surface extending between the back and front ends, thereby forming a wedge shape. The male shim defines an elongate opening extending between a first side and an opposed second side of the male shim and the elongate opening extends through the base surface, through the opposed sloped contact surface and also extends through the thin end of the male shim. The adjustment pull tang is secured within the elongate opening and extends within the elongate opening from a shim terminus of the elongate opening and beyond the opening and through the thin end of the male shim. The pull tang extends beyond the thin end of the shim a distance that is greater than a distance between the thick end and thin end of the male shim. The integral shim-pack also includes a wedge-shaped female shim that, like the male shim, has a thick back end and an opposed thin front end, a base surface and an opposed sloped contact surface extending between the back and front ends. The female shim defines a tang groove that extends along the sloped contact surface between a first side and an opposed second side of the female shim and also extends along the surface to and through the thick end. The female shim also includes a bridge passing over the tang groove to define a tang passage at the thick end of the female shim. The tang groove is configured to receive the pull tang of the male shim whenever the sloped contact surface adjacent the thin end of the male shim is positioned adjacent and overlying the sloped contact surface adjacent the thin end of the female shim. The tang groove and bridge are also configured so that the pull tang extends between the bridge and the tang groove through the tang passage and beyond the thick end of the female shim.

Whenever the base surface of the male shim is secured adjacent the first structural surface, the base surface of the female shim is secured adjacent the second structural surface, the thin end of the male shim is positioned adjacent and overlying the thin end of the female shim, and the pull tang extends within the tang groove, through the tang passage and beyond the thick end of the female shim, movement of the pull tang away from the thick end of the female shim moves the sloped contact surface of the male shim along the sloped contact surface of the female shim to increase a distance between the base surfaces of the shims and to thereby adjust a distance between the structural surfaces.

In one aspect of the integral shim-pack with an adjustment pull tang, the pull tang defines a plurality of ratchet teeth upon a top surface of the pull tang. Additionally, the bridge passing over the tang groove at the thick end of the female shim is a pawl bridge that includes a pawl extending from the bridge into the tang groove to irreversibly engage the ratchet teeth of the pull tang. This arrangement permits selective movement of the thick end of the male shim toward the thick end of the female shim, and also prevents movement of the thick end of the male shim away from the thick end of the female shim.

In another aspect, the integral shim-pack is constructed so that the pull tang has a linear elasticity. This means that the pull tang without any force applied to it extends beyond the thin end of the male shim in a direction about parallel to a plane defined by the contact surface of the male shim. However, whenever the pull tang is within the tang groove of the female shim, the pull tang bends away from the plane defined by the contact surface of the male shim and toward the base surface of the female shim. This bending force is countered by the linear elasticity force of the pull tang which forces the ratchet teeth of the pull tang against the pawl of the pawl bridge. When the pawl of the pawl bridge engages the ratchet teeth of the pull tang, the pawl permits motion of the pull tang in only one direction, namely in a direction away from the thick end of the female shim.

In yet another embodiment of the integral shim-pack with an adjustment pull tang, the tang passage defined by the pawl bridge and tang groove of the female shim may be defined to have a cross-sectional area sufficiently large to permit the pull tang to be selectively moved away from the pawl bridge so that the pawl disengages from the ratchet teeth. This permits reversible movement of the pull tang so that the thick ends of the shims may move toward and away from each other by movement of the pull tang. Release by an operator of the pull tang permits the linear elasticity force of the pull tang to move toward the pawl so that the pawl again engages one of the ratchet teeth of the pull tang to return to one-way movement of the pull tang.

In a further aspect of the integral shim-pack, the shim-pack may include at least one mounting plate extending away from the base surface of the female shim. The mounting plate extends in a direction about parallel to a plane defined by the base surface of the female shim to facilitate mounting the base surface of the female shim to the first or second structural surface of a frame. The integral shim-pack is preferably made of a plastic material.

Accordingly, it is a general purpose of this disclosure to provide an integral shim-pack with an adjustment pull tang that overcomes deficiencies of the prior art.

It is a more specific purpose to provide an integral shim-pack with an adjustment pull tang that can be easily manufactured through a plastic injection molding process to minimize costs, and that can be efficiently utilized by one hand of an operator while the other hand of the operator is utilized to adjust the insertable structure to be level, plumb and/or square and also to manage any leveling tools.

These and other purposes and advantages of the present integral shim-pack with an adjustment pull tang will become more readily apparent when the following description is read in conjunction with the accompanying drawings.

PREFERRED EMBODIMENTS OF THE DISCLOSURE

Figure 1:
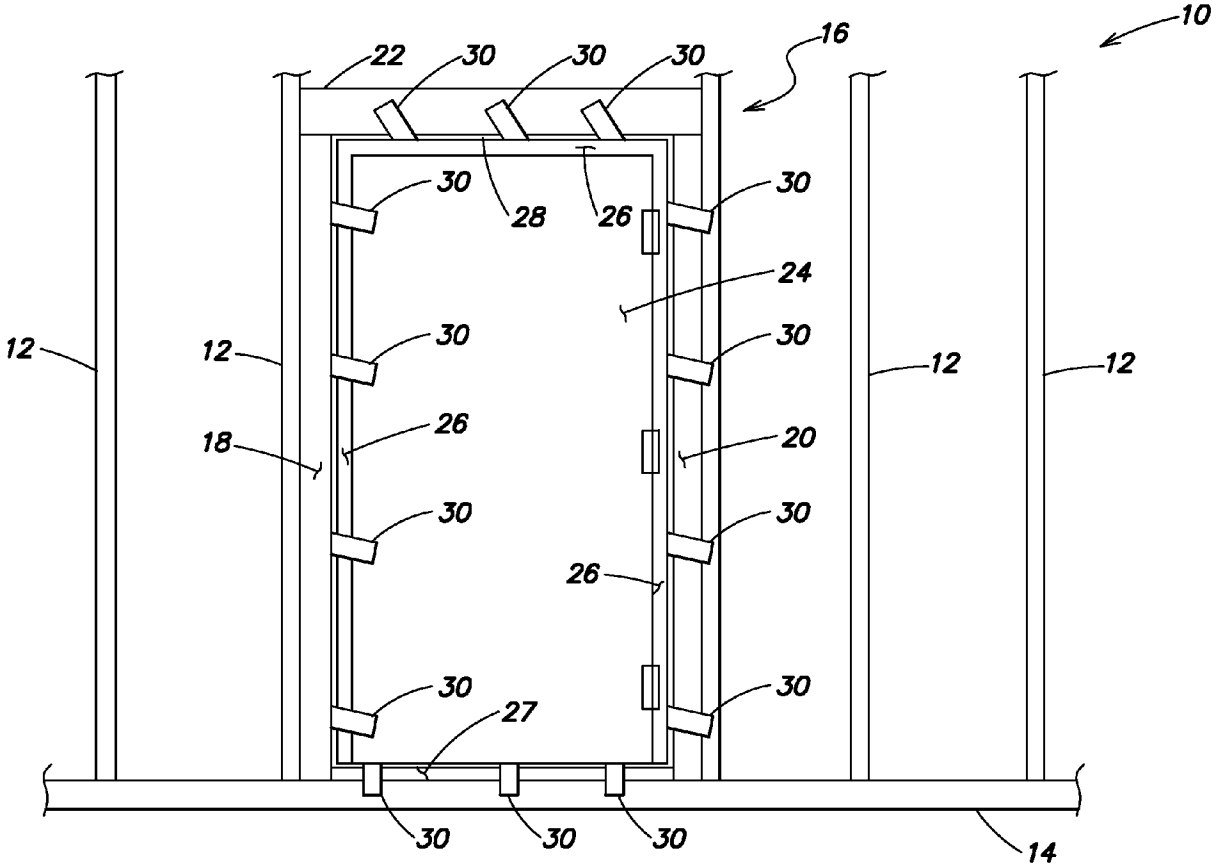
FIG. 1 (Prior Art)
FIG. 1 is a front plan view of a prior art building showing a frame opening configured for receiving an insertable structure door, and showing traditional locations for use of shims within a gap between the door and the frame opening to make the door level, square and plumb.

Referring to the drawings in detail, FIG. 1 shows a prior art building frame section 10 including several vertical framing studs 12 extending upward from a sill 14. The frame section 10 also includes an opening frame 16 having a first side structure 18, and opposed second side structure 20 extending above the sill 14 and connected by a top header 22. The opening frame 16 is configured to receive and house a door 24 that is secured within its own exterior door frame 26 that surrounds all four sides of the door 24, including a frame base 27 dimensioned to be secured over the sill 14. A gap 28 is defined between the door frame 26 and the opening frame 16 for absorbing and transferring loads across the opening frame 16. A plurality of prior art shims 30 are shown in many positions extending out of the gap 28 between the opening frame 16 and the exterior door frame 26. Such wedge-shaped prior art shims 30 are used to adjust distances within the gap 28 between the exterior door frame 26 and the opening frame 16 to render the door level, square and plumb. The FIG. 1 prior art building frame section 10 shows a typical working environment of the integral shim-pack with an adjustment pull tang 50 (shown in FIGS. 2 and 4-5) of the present disclosure, wherein integral shim-packs with adjustment pull tangs 50 would be used instead of the prior art shims 30.

Figure 2:
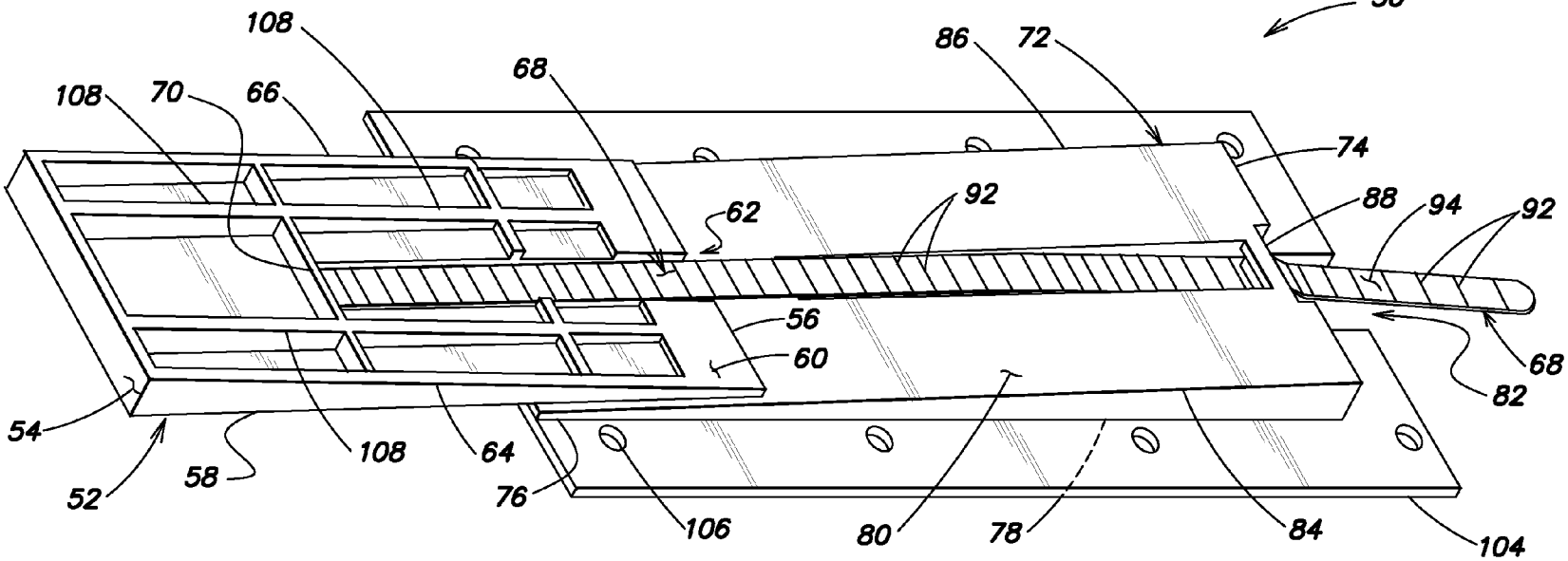
FIG. 2 is a top perspective view of an integral shim-pack with an adjustment pull tang constructed in accordance with the present disclosure, showing a pull tang extending from a male shim through a tang groove defined within a contact surface of a female shim and extending under a bridge over the tang groove and extending beyond a thick end of the female shim.
Figure 3A:
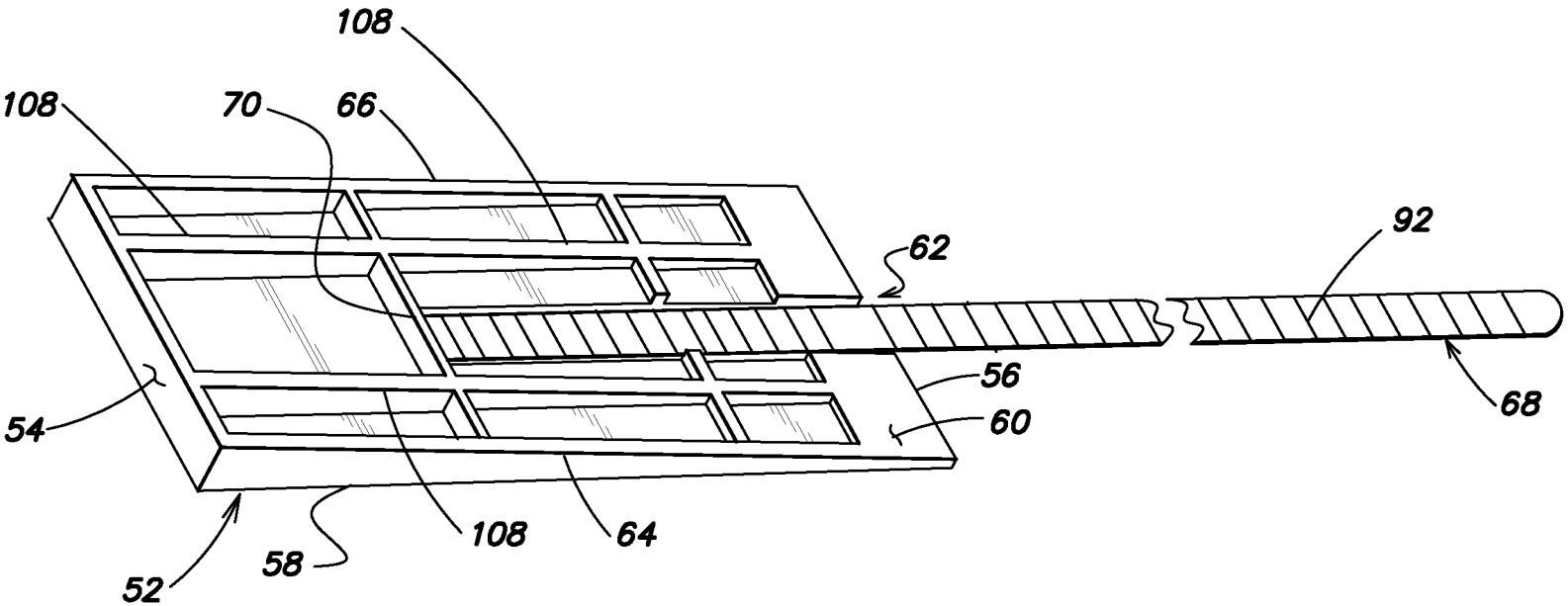
FIG. 3A shows a top perspective view of the FIG. 2 male shim separated from the female shim.
Figure 3B:
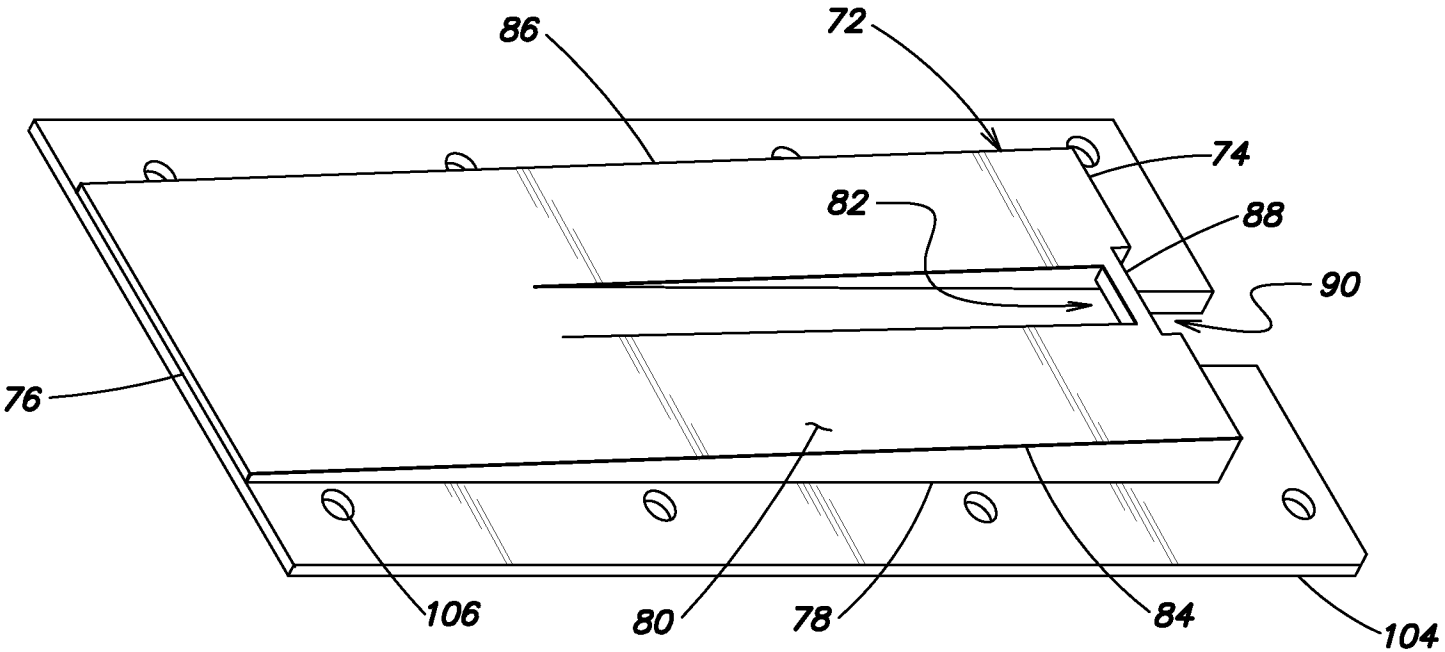
FIG. 3B is a top perspective view of the FIG. 2 female shim separated from the male shim.
Figure 4:
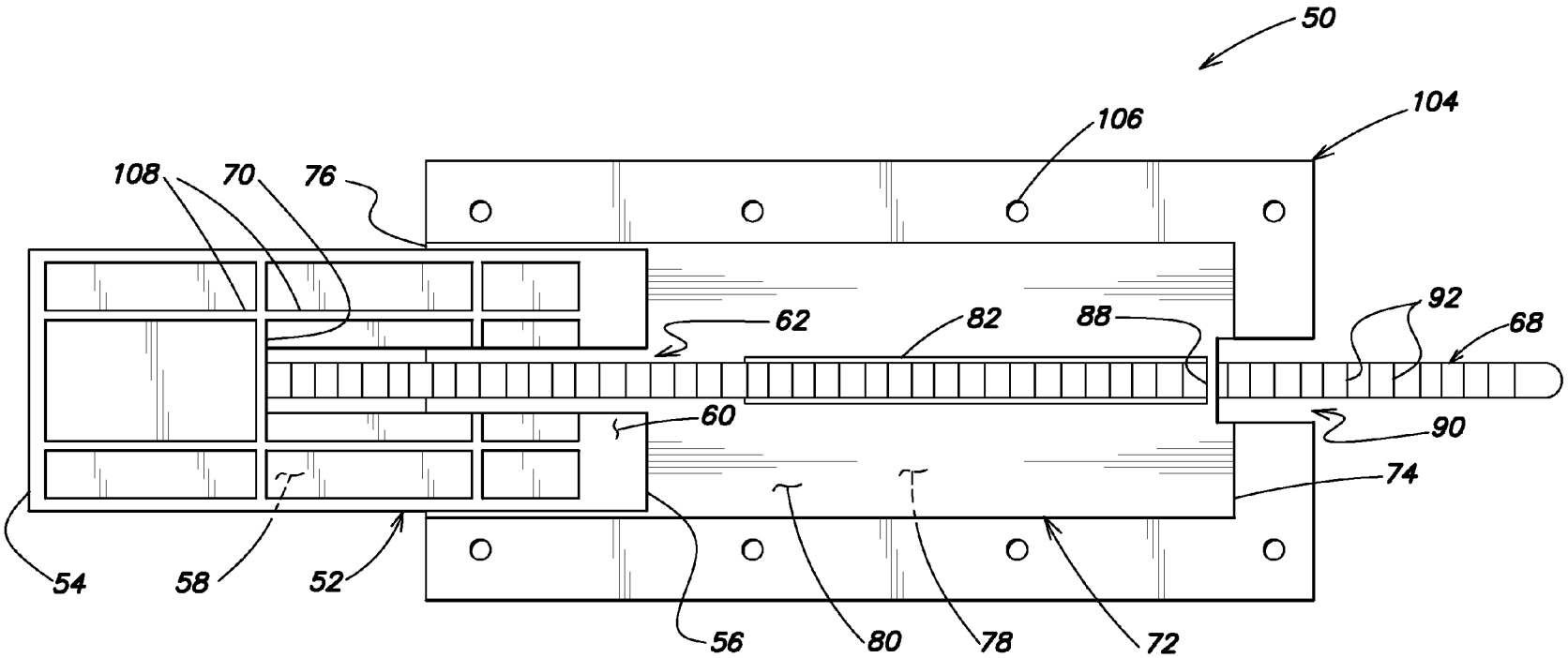
FIG. 4 is a top plan view of the FIG. 2 integral shim-pack with an adjustment pull tang.
Figure 5:
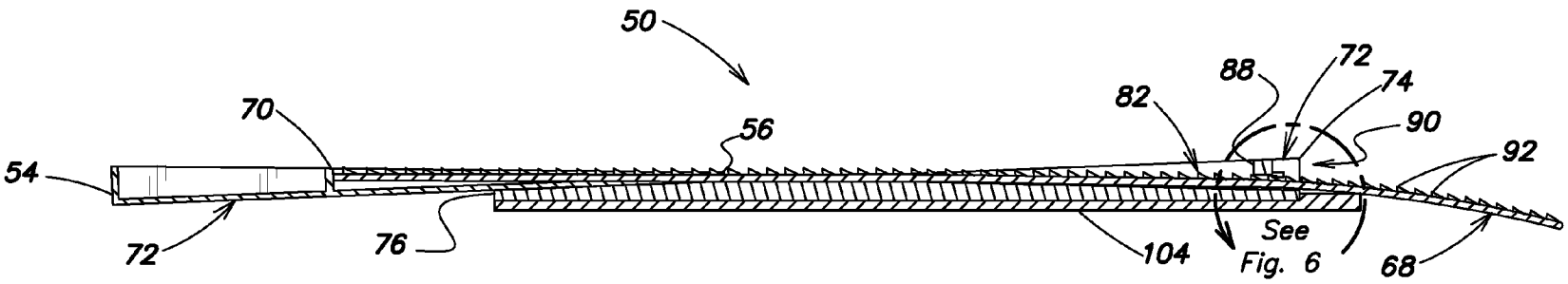
FIG. 5 is a side plan view of an integral shim-pack with an adjustment pull tang showing the pull tang extending from a shim terminus within the male shim, through the tang groove of the female shim, and beyond a thick end of the female shim.

The integral shim-pack 50 with an adjustment pull tang for adjusting distances between a first structural surface (such as the first side structure 18) and an opposed second structural surface (such as the exterior door frame 26) is best shown in FIGS. 2 and 4-5. The integral shim-pack 50 includes a wedge-shaped male shim 52 having a thick back end 54 and an opposed thin front end 56, having a base surface 58 and having an opposed sloped contact surface 60 extending between the back end 54 and front end 56 to form a wedge shape. The male shim 52 defines an elongate opening 62 (shown also in FIG. 3A) extending between a first side 64 and an opposed second side 66 of the male shim 52. The elongate opening 62 may also extend through the base surface 58 through the opposed sloped contact surface 60 and also extends through the thin front end 56 of the male shim 52. The adjustment pull tang 68 is secured within the elongate opening 62 and extends within the elongate opening 62 from a shim terminus 70 of the elongate opening 62 and beyond the opening 62 and through the front thin end 56 of the male shim 52. The pull tang 68 extends beyond the thin end 56 of the male shim 52 a distance that is greater than a distance between the thick back end 54 and thin front end 56 of the male shim 52.

The integral shim-pack also includes a wedge-shaped female shim 72 that, like the male shim 52, has a thick back end 74 and an opposed thin front end 76, a base surface 78 and an opposed sloped contact surface 80 extending between the back end 74 and front end 76. The female shim 72 defines a tang groove 82 that extends along the sloped contact surface 80 between a first side 84 and an opposed second side 86 of the female shim 72 and also extends along the contact surface 30 to and through the thick end 74.

The female shim 72 also includes a bridge 88 passing over the tang groove 82 from the first side 84 to the second side 86 adjacent the thick back end 74 to define a tang passage 90 (shown best in FIG. 6) at the thick end 74 through which the pull tang 68 extends beyond the thick end 74 of the female shim 72. The tang groove 82 is configured to receive the pull tang 68 of the male shim 52 whenever the sloped contact surface 60 adjacent the thin end 56 of the male shim 52 is positioned adjacent and overlying the sloped contact surface 80 adjacent the thin end 76 of the female shim 72, as shown in FIGS. 2, 4, and 5. The tang groove 82 and bridge 88 are also configured so that the pull tang 68 extends between the bridge 88 and the tang groove 82 through the tang passage 90 and beyond the thick end 74 of the female shim 72.

As recited above, the integral shim-pack 50 is configured so that, whenever the base surface 58 of the male shim 52 is secured adjacent a first structural surface (such as the sill 14 of FIG. 1), the base surface 78 of the female shim 72 is secured adjacent a second structural surface (such as the frame base 27 of the exterior door frame 26 of FIG. 1), the thin end 56 of the male shim 52 is positioned adjacent and overlying the thin end 76 of the female shim 72, and the pull tang 68 extends along the tang groove 82, through the tang passage 90 and beyond the thick end 74 of the female shim 72, then movement of the pull tang 68 away from the thick 74 end of the female shim 72 moves the sloped contact surface 60 of the male shim 52 along the sloped contact surface 80 of the female shim 72 to increase a distance between the base surfaces 53, 78 of the shims 52, 72 and to thereby adjust a distance between the structural surfaces 14, 27.

Figure 6:
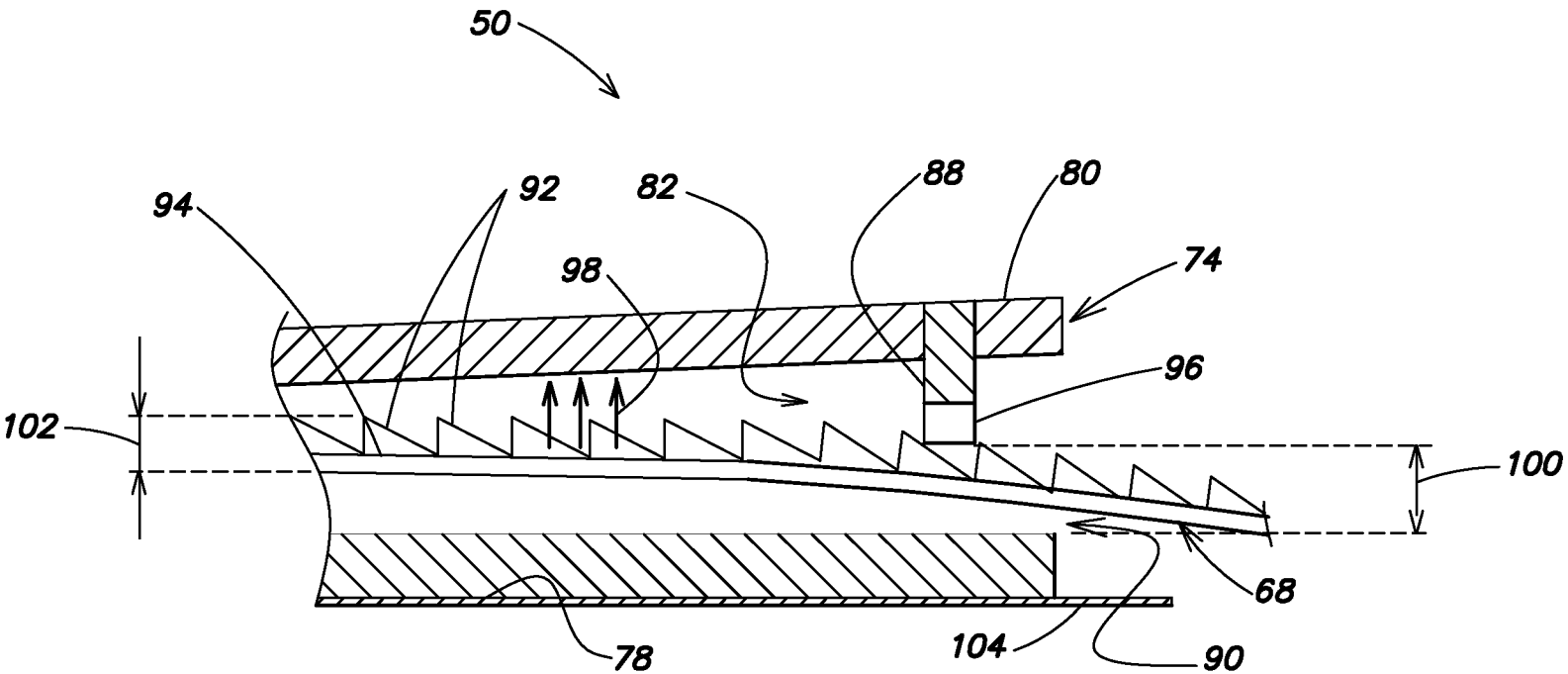
FIG. 6 is an expanded, cross-sectional view of the FIG. 5 integral shim-pack, showing a section of the FIG. 5 integral shim-pack extending between sectional lines 6-6 of FIG. 5.

In a further embodiment of the integral shim-pack 50 with an adjustment pull tang 68, the pull tang 63 may define a plurality of ratchet teeth 92 (shown best in FIG. 6) upon a top surface 94 of the pull tang 68. Additionally, the bridge 88 passing over the tang groove 82 at the thick back end 74 of the female shim 72 is a pawl bridge 88 that includes a pawl 96 extending from the bridge into the tang groove 82 and tang passage 90 to irreversibly engage the ratchet teeth 92 of the pull tang 68, as shown in FIG. 6. This arrangement permits selective movement of the thick back end 54 of the male shim 52 toward the thick back end 74 of the female shim 72, and also prevents movement of the thick back end 54 of the male shim 52 away from the thick back end 74 of the female shim 72.

In another aspect, the integral shim-pack 50 is constructed so that the pull tang 68 has a linear elasticity. This means that the pull tang 68 without any external force applied to it extends beyond the thin end 56 of the male shim 52 in a direction about parallel to a plane defined by the contact surface 60 of the male shim 52. However, whenever the pull tang 68 is within the tang groove 82 and extends through the tang passage 90 between the bridge 88 and the tang groove 82 of the female shim 72, the pull tang bends away from the plane defined by the contact surface 60 of the male shim 52 and toward the base surface 78 of the female shim 72. This bending force is countered by the linear elasticity force (shown in FIG. 6 with three arrows designated with reference numerals 98) of the pull tang 68 which forces the ratchet teeth 92 of the pull tang 63 against the pawl 96 of the pawl bridge 88. When the pawl 96 of the pawl bridge 88 engages the ratchet teeth 92 of the pull tang 68, the pawl 96 permits motion in only one direction, namely in a direction away from the thick end 74 of the female shim 72.

In yet another embodiment of the integral shim-pack 50 with an adjustment pull tang 68, the tang passage 90 defined by pawl bridge 83, pawl 96 and the tang groove 82 of the female shim may be defined to have a cross-sectional area (represented by reference numeral 100 in FIG. 6) that is greater than a greatest cross-sectional area of the pull tang 68 and ratchet teeth 92 on the pull tang 68 (represented by reference numeral 102 in FIG. 6) so that the cross-sectional area 100 of the tang passage 90 is sufficiently large to permit the pull tang 68 to be selectively moved away from the pawl bridge 88 so that the pawl 96 disengages from the ratchet teeth 92. This permits reversible movement of the pull tang 68 so that the thick end 54 of the male shim 52 and the thick end 74 of the female shim 72 may move may move toward and away from each other by two-way movement of the pull tang 68. After such two-way movement of the pull tang 68, release by an operator (not shown) of the pull tang 68 permits the linear elasticity force 98 of the pull tang 68 to move toward the pawl 96 so that the pawl 96 again engages one of the ratchet teeth 92 of the pull tang 68 to return to one-way movement of the pull tang 68.

In a further aspect of the integral shim-pack 50, the shim-pack 50 may include at least one mounting plate 104 extending away from the base surface 78 of the female shim 72. The mounting plate 104 extends in a direction about parallel to a plane defined by the base surface 78 of the female shim to facilitate mounting the base surface 78 of the female shim to the first structural surface 14 of an opening frame 18 or to the second structural surface 27 of the exterior frame 26 of an insertable object, such as the door 24 of FIG. 1. The mounting plate 104 may extend from several sides of the female shim 72, or may simply extend from one side (not shown). The integral shim-pack 50 with an adjustment pull tang 68 is preferably made of a plastic material.

A great advantage of the present integral shim-pack 50 with an adjustment pull tang 68 is that, by being integral so that the male shim 52 and female shim 72 are connected to each other by the pull tang 68 passing along the tang groove 82 and through the tang passage 90, a person (not shown) using the shim-pack 50 may place the shim-pack 50 with only one hand, leaving the person's other hand free to adjust the pull tang 68 and/or leveling measurement instruments (not shown) on the door 24 or other insertable object. Because the male shim 52 and female shim 72 are integral, or connected to each other prior to use, the integral shim-pack 50 may be easily inserted from only one side of the door 24. This facilitates retention of the door 24 within its exterior frame 26 during installation. In prior art installations of doors and windows, it is common to separate the exterior frames from the doors and windows to make it easy to use separate shims from both sides of the exterior frame 26 by simply reaching through the open exterior frame 26. After the frame 26 is made level, plumb and square by use of shims or shim pairs, the door 26 or window (not shown), etc. is re-secured within its exterior frame 26.

In contrast, use of the integral shim-pack 50 facilitates insertion of the shim-pack into the gap 28 between the opening frame 16 and the door 24 exterior frame 26 from only one side while the shim-pack is in a thinnest disposition, meaning when the thin end 56 of the male shim 52 barely contacts the thin end 76 of the female shim 74. Because the door 25 is not removed from its exterior frame 26 by use of the present integral shim-pack 50, the exterior frame 26 is more likely to remain square, and not be moved out of square while the integral shim-packs 50 are used to level, square and plumb the door 24.

An additional benefit of the present integral shim-pack 50 is that, because the shims 52, 72 are integral, they may be attached to a structural surface, such as the opening frame 16 of exterior frame 25 prior to insertion of the door 24 into the opening frame 16. For example, two or more integral shim-packs 50 may first be secured to the sill 14 within the opening frame 16 and then adjusted by movement of the pull tang 68 to define a level plane between the shim-packs 50, and then secured in the level adjusted positions to the sill 14. Then, two or more integral shim-packs 50 may be secured to either the left vertical side structural surface 18 or the right vertical side structural surface 20 by their mounting plates 104 being nailed through mounting holes 106 to the surfaces 18 or 20. Then, the integral shim-packs 50 are adjusted by movement of their pull tangs 68 to define a plumb vertical plane between the shim-packs 50 on the structural surface 18 or 20. The adjusted shim-packs 50 are then nailed or otherwise secured in their adjusted positions to the vertical structural surface 18 or 20.

Next, the door 24 or other insertable structure is positioned within the opening frame 16. Because the sill 14 and a vertical structural surface 18 or 20 are already adjusted to be level and plumb, the door 24 only has to be positioned to contact the integral, adjusted shim-packs 50 on the sill 14 and on the vertical structural surface 18 or 20 to be level, square and plumb. All that is then needed is that additional integral shim-packs 50 be inserted in the gap 28 between the other, non-adjusted vertical structural surface 18 or 20 and the top header 22, and then adjusted by movement of their pull tangs 68 to expand the shim-packs to firmly contact the adjacent structural surfaces to thereby secure the door 24 level, square and plumb within the opening frame 16. These adjusted, integral shim-packs 50 are then secured to the opening frame 16 and exterior frame 26 to efficiently, quickly, and accurately secure the door 24 within the opening frame 16. It is stressed, that when the shim-packs 50 are inserted in the gap 28 or otherwise positioned between the structural surfaces, the pull tangs 68 extend through and beyond the tang passages 90 of the shim-packs 50, and beyond the thick ends 74 of the female shims 72 and out of either side of the gap 28 (depending upon how they were inserted) so that the pull tangs 68 may be easily grasped by the operator for pulling of the pull tangs 68 to adjust the thicknesses of the shim-packs 50.

A further advantage of the present integral shim-pack 50 arises whenever a shim-pack 50 has to be used in a vertical corner disposition, as opposed to a flat, horizontal or non-corner vertical disposition. For a vertical corner use, the thick end 54 of the male shim 52 may be secured to be upward in a highest location along a structural surface, such as having the thick end of the male shim 52 to be positioned to abut a top corner of the opening frame 16 where the left or first side structure meets the top header 22. In such a vertical deployment, the female shim 72 may be secured by nails through the mounting holes 106 in the mounting plate 104 to prohibit any movement by gravity of the female shim 72. Adjustment by the pull tang 68 thereafter only moves the male shim 52 downwards to increase a distance between the base surfaces 58, 78 of the shims 52, 72 to adjust the shim-pack 50 to a desired thickness.

In a non-corner vertical disposition of the shim-pack 50, the female shim 72 may be positioned to be vertically above the male shim 52 and then fastened to the surface structure by nailing or otherwise securing the mounting plate 104 to the surface structure 18 or 20. Because the ratchet teeth 92 of the pull tang 68 are forced by linear elasticity against the pawl 96, and because the ratchet teeth 92 only permit one-way movement of the pull tang 68 away from the female shim 72, the unsecured male shim 52 is prohibited from moving downward by force of gravity. To adjust a thickness of such a non-corner vertical disposition of the integral shim-pack 50, the pull tang 68 of the male shim 52 is simply pulled upward until a desired thickness is achieved. Again, because of the irreversible, one-way movement of the pull tang 68 resulting from the interaction of the ratchet teeth 92 and pawl 96, once adjusted to the desired thickness, the male shim 52 cannot move out of the desired adjustment during further adjustments or other activities, such as inserting the door 24 into the opening frame 16 after the non-corner vertical securing of the integral shim-pack 50.

In a preferred manufacture of the integral shim-pack 50 with an adjustment pull tang 68 of plastic material, it is anticipated that the resulting male shim 52 and female shim 72 may not be solid and instead may have strengthening ribs. For example, as shown in FIGS. 2, 3A, and 4 strengthening ribs 108 may be formed on the male shim 52 in a manner common to products made of plastic that require substantial strength, but that seek to minimize material requirements.

For purposes herein, the word "about" is to mean plus or minus ten percent.

While the present disclosure has been presented above with respect to the described and illustrated embodiments of the integral shim-pack 50 with an adjustment pull tang 68, it is to be understood that the disclosure is not to be limited to those illustrations and described embodiments. For example, while the shim-packs 50 are described as adjusting distances between first and second "structural surfaces" such as surfaces of doors, windows, and opening frames or exterior frames thereof, etc., it is to be understood that the phrase "structural surfaces" may apply to any other different types of surfaces, including, cabinets, levelling crowned floor joists or unequal sized floor joists, etc. Additionally, while the elongate opening 62 of the male shim is described as preferably passing from the shim terminus 70 through both the base surface 58 and opposed sloped contact surface 60 of the male shim 52, it is to be understood that the elongate opening may simply be a slot defined between the surfaces 58, 60, a groove defined in one of the surfaces 58, 60. Alternatively, in another embodiment, the male shim 52 may have no elongate opening such that the pull tang 68 simply extends from and beyond the thin end 56 of the male shim 52. In such a configuration, the male shim 52 would simply be dimensioned so that the front thin end 56 could not pass over or beyond the bridge 88 of the female shim 72, to thereby permit the pull tang 68 to descend into the tang groove 82 under the bridge 88 when the pull tang 68 is at a maximum extension. Additionally, the sloped contact surfaces 60, 80 of the male shim 52 and female shim 72 may have alignment and/or lock channels (not shown) on one of the surfaces 60, 80 and corresponding alignment and/or lock ridges (not shown) on the other of the surfaces 60, 80 to help secure the shim packs 50 as integral units that cannot be separated without sliding them away from each other, and to align the male shim 52 and female shim 72 directly adjacent each other as the pull tang 68 adjusts the position of the shims 52, 72 relative to each other. Accordingly, reference should be made primarily to the following claims rather than the forgoing description to determine the scope of the disclosure.

What is claimed is:

1. An integral shim-pack with a flexible adjustment pull tang for adjusting distances between a first structural surface and an opposed second structural surface, the integral shim-pack comprising:

a. a wedge-shaped male shim having a thick back end and an opposed thin front end, having a base surface and an opposed sloped contact surface extending between the back and front ends, and the male shim including the flexible adjustment pull tang secured to the male shim and extending beyond the thin front end a distance that is greater than a distance between the thick back end and thin front end of the male shim;

b. a wedge-shaped female shim having a thick back end and an opposed thin front end, having a base surface and an opposed sloped contact surface extending between the back and front ends, and the female shim defining a tang groove extending along the sloped contact surface between a first side and an opposed second side of the female shim to and through the thick end, the female shim also including a bridge passing over the tang groove at the thick end to define a tang passage at the thick end through which the tang extends beyond the thick end of the female shim; and, c. the tang groove being configured to receive the pull tang of the male shim whenever the sloped contact surface adjacent the thin end of the male shim is positioned adjacent and overlying the sloped contact surface adjacent the thin end of the female shim, and the tang groove and bridge being configured so that the pull tang extends between the bridge and the tang groove and beyond the thick end of the female shim.

2. The integral shim-pack with an adjustment pull tang of claim 1, wherein the pull tang defines a plurality of ratchet teeth upon a top surface of the pull tang, wherein the bridge passing over the tang groove at the thick end of the female shim is a pawl bridge including a pawl extending from the bridge into the tang groove to irreversibly engage the ratchet teeth of the pull tang to thereby permit selective movement of the thick end of the male shim toward the thick end of the female shim, and to prevent movement of the thick end of the male shim away from the thick end of the female shim.

3. The integral shim-pack with an adjustment pull tang of claim 2, further comprising:

a. the pull tang having a linear elasticity, the pull tang extending beyond the thin end of the male shim in a direction about parallel to a plane defined by the contact surface of the male shim, so that whenever the pull tang is within the tang groove of the female shim, the pull tang bends away from the plane defined by the contact surface of the male shim and toward the base surface of the female shim, and the linear elasticity force of the pull tang forces the ratchet teeth of the pull tang against the pawl of the pawl bridge; and, b. the pawl bridge and tang groove of the female shim defining a tang passage having a cross-sectional area that is greater than a greatest cross-sectional area of the pull tang and ratchet teeth on the pull tang, so that the cross-sectional area of the tang passage is sufficiently large to permit the pull tang to be selectively moved away from the pawl bridge so that the pawl disengages from the ratchet teeth to thereby permit reversible movement of the pull tang so that the thick ends of the shims may move toward and away from each other by movement of the pull tang.

4. The integral shim-pack with an adjustment pull tang of claim 1, further comprising at least one mounting plate extending away from the base surface of the female shim, the mounting plate extending in a direction about parallel to a plane defined by the base surface of the female shim.

5. The integral shim-pack with an adjustment pull tang of claim 1, wherein the shim-pack is made of a plastic material.

6. An integral shim-pack with a flexible adjustment pull tang for adjusting distances between a first structural surface and an opposed second structural surface, the integral shim-pack comprising:

a. a wedge-shaped male shim having a thick back end and an opposed thin front end, having a base surface and an opposed sloped contact surface extending between the back and front ends, and the male shim defining an elongate opening extending between a first side and an opposed second side of the male shim and the elongate opening extending through the base surface, through the sloped contact surface and through the thin end of the male shim, and the male shim including the flexible adjustment pull tang secured within the elongate opening and extending within the elongate opening from a shim terminus of the elongate opening beyond the thin end of the male shim a distance that is greater than a distance between the thick end and thin end of the male shim;

b. a wedge-shaped female shim having a thick back end and an opposed thin front end, having a base surface and an opposed sloped contact surface extending between the back and front ends, and the female shim defining a tang groove extending along the sloped contact surface between a first side and an opposed second side of the female shim to and through the thick end, the female shim also including a bridge passing over the tang groove at the thick end to define a tang passage at the thick end through which the tang extends beyond the thick end of the female shim;

c. the tang groove being configured to receive the pull tang of the male shim whenever the sloped contact surface adjacent the thin end of the male shim is positioned adjacent and overlying the sloped contact surface adjacent the thin end of the female shim, and the tang groove and bridge being configured so that the pull tang extends between the bridge and the tang groove and beyond the thick end of the female shim; and, d. the shim-pack being configured so that, whenever the base surface of the male shim is secured adjacent the first structural surface, the base surface of the female shim is secured adjacent the second structural surface, the thin end of the male shim is positioned adjacent and overlying the thin end of the female shim, and the pull tang extend through the tang passage beyond the thick end of the female shim, movement of the pull tang away from the thick end of the female shim moves the sloped contact surface of the male shim along the sloped contact surface of the female shim to increase a distance between the base surfaces of the shims and to thereby adjust a distance between the structural surfaces.

7. The integral shim-pack with an adjustment pull tang of claim 6, wherein the pull tang defines a plurality of ratchet teeth upon a top surface of the pull tang, wherein the bridge passing over the tang groove at the thick end of the female shim is a pawl bridge including a pawl extending from the bridge into the tang groove to irreversibly engage the ratchet teeth of the pull tang to thereby permit selective movement of the thick end of the male shim toward the thick end of the female shim, and to prevent movement of the thick end of the male shim away from the thick end of the female shim.

8. The integral shim-pack with an adjustment pull tang of claim 7, further comprising:

a. the pull tang having a linear elasticity, the pull tang extending beyond the thin end of the male shim in a direction about parallel to a plane defined by the contact surface of the male shim, so that whenever the pull tang is within the tang groove of the female shim, the pull tang bends away from the plane defined by the contact surface of the male shim and toward the base surface of the female shim, and the linear elasticity of the pull tang forces the ratchet teeth of the pull tang against the pawl of the pawl bridge;

b. the pawl bridge and tang groove of the female shim defining a tang passage having an area sufficiently large to permit the pull tang to be selectively moved away from the pawl bridge so that the pawl disengages from the ratchet teeth to thereby permit reversible movement of the pull tang so that the thick ends of the shims may move toward and away from each other by movement of the pull tang.

* * * * *